US008525688B2

(12) United States Patent
Chatterjee et al.

(10) Patent No.: US 8,525,688 B2
(45) Date of Patent: Sep. 3, 2013

(54) PROXIMITY DETECTION ALARM FOR AN INDUCTIVELY CHARGED MOBILE COMPUTING DEVICE

(75) Inventors: Manjirnath Chatterjee, San Francisco, CA (US); Peter N. Skillman, San Carlos, CA (US); Yoshimichi Matsuoka, Cupertino, CA (US)

(73) Assignee: Palm, Inc., Sunnyvale, CA (US)

( * ) Notice: Subject to any disclaimer, the term of this patent is extended or adjusted under 35 U.S.C. 154(b) by 195 days.

(21) Appl. No.: 12/987,940

(22) Filed: Jan. 10, 2011

(65) Prior Publication Data

US 2012/0176249 A1 Jul. 12, 2012

(51) Int. Cl.
*G08B 13/08* (2006.01)

(52) U.S. Cl.
USPC ..... 340/686.1; 340/686.6; 340/545.3

(58) Field of Classification Search
USPC ..... 343/906; 340/5.74, 686.1, 686.6, 340/545.3; 320/108
See application file for complete search history.

(56) References Cited

U.S. PATENT DOCUMENTS

| | | | | |
|---|---|---|---|---|
| 3,938,018 | A * | 2/1976 | Dahl | 320/140 |
| 4,549,264 | A * | 10/1985 | Carroll et al. | 705/32 |
| 5,455,466 | A * | 10/1995 | Parks et al. | 307/104 |
| 6,331,744 | B1 * | 12/2001 | Chen et al. | 310/171 |
| 6,553,263 | B1 * | 4/2003 | Meadows et al. | 607/61 |
| 6,906,495 | B2 * | 6/2005 | Cheng et al. | 320/108 |
| 7,151,460 | B2 * | 12/2006 | Makela et al. | 340/628 |
| 7,772,802 | B2 * | 8/2010 | Manico et al. | 320/108 |
| 7,952,324 | B2 * | 5/2011 | Cheng et al. | 320/108 |
| 8,207,906 | B2 * | 6/2012 | Tiscareno et al. | 343/906 |
| 8,264,340 | B2 * | 9/2012 | Mazzolini et al. | 340/521 |
| 2001/0045785 | A1 * | 11/2001 | Chen et al. | 310/104 |
| 2002/0096543 | A1 * | 7/2002 | Juselius | 222/631 |
| 2003/0030342 | A1 * | 2/2003 | Chen et al. | 310/102 R |
| 2004/0014478 | A1 * | 1/2004 | Hoffman et al. | 455/456.1 |
| 2007/0114967 | A1 * | 5/2007 | Peng | 320/101 |
| 2007/0179414 | A1 * | 8/2007 | Imboden et al. | 601/72 |
| 2007/0182367 | A1 * | 8/2007 | Partovi | 320/108 |
| 2008/0001743 | A1 * | 1/2008 | Gallagher | 340/571 |
| 2008/0258679 | A1 * | 10/2008 | Manico et al. | 320/106 |
| 2009/0096413 | A1 * | 4/2009 | Partovi et al. | 320/108 |
| 2009/0128346 | A1 * | 5/2009 | Zhao et al. | 340/636.15 |
| 2009/0146608 | A1 * | 6/2009 | Lee | 320/108 |
| 2010/0041333 | A1 * | 2/2010 | Ungari et al. | 455/41.2 |
| 2010/0045455 | A1 * | 2/2010 | Mazzolini et al. | 340/521 |
| 2010/0127659 | A1 * | 5/2010 | Klinghult | 320/108 |
| 2010/0188237 | A1 * | 7/2010 | Monks et al. | 340/635 |
| 2011/0074342 | A1 * | 3/2011 | MacLaughlin | 320/108 |
| 2011/0109264 | A1 * | 5/2011 | Choi | 320/108 |
| 2011/0181238 | A1 * | 7/2011 | Soar | 320/108 |

(Continued)

FOREIGN PATENT DOCUMENTS

WO WO 2008060636 A2 * 5/2008

*Primary Examiner* — Jennifer Mehmood
*Assistant Examiner* — Rufus Point

(57) ABSTRACT

Illustrated is a system and method to activate an alarm where a mobile computing device is no longer proximate to a docking station that provides inductive charging and data transfer capabilities for the mobile computing device. The computer system includes at least one coil to provide inductive charging for a mobile computing device. Further, the computer system includes a processor to control the inductive charging of the mobile computing device. Additionally, the computer system includes a proximity sensor operatively connected to the processor, the proximity sensor to determine that the mobile computing device is proximate to the computer system. Moreover, the computer system includes an alarm logic module to activate an alarm when the mobile computing device is no longer proximate to the computer system.

13 Claims, 12 Drawing Sheets

(56) References Cited

U.S. PATENT DOCUMENTS

2012/0025942 A1* 2/2012 Bhat et al. ..... 336/221
2012/0030393 A1* 2/2012 Ganesh et al. ..... 710/303
2012/0052923 A1* 3/2012 Park ..... 455/567
2012/0115549 A1* 5/2012 Kim et al. ..... 455/566

* cited by examiner

PROXIMITY DETECTION ALARM FOR AN INDUCTIVELY CHARGED MOBILE COMPUTING DEVICE

CROSS REFERENCE TO RELATED APPLICATIONS

This application is related to U.S. patent application Ser. No. 12/239,656 titled "Orientation and Presence Detection For Use in Configuring Operations of Computing Devices In Docked Environments" filed on Sep. 26, 2008, and which is incorporated by reference in its entirety.

BACKGROUND

The use of docking stations and other accessory devices in connection with mobile computing devices (e.g. smart phones, media players etc.) is well known. Traditionally, docking stations are used to (i) recharge or supply power to the mobile computing device, (ii) enable the computing device to communicate with other devices connected to the docking station (e.g. synchronization with a personal computer), or (iii) use additional resources provided with the docking station (e.g. speakers for audio output).

In a traditional scheme, docking stations and mobile computing devices connect using insertive male/female connectors. Numerous factors come into consideration when mobile devices are designed with connectors for use with docking stations. For example, such connectors typically take into account the ease by which users may establish the connection (e.g. can the user simply drop the device into the cradle), as well as the mechanical reliability of the connectors. When users repeatedly mate devices with docking stations, both the mating action and the removal of the device from the docking station can strain the connector structure and its elements.

BRIEF DESCRIPTION OF THE DRAWINGS

Some embodiments of the invention are described, by way of example, with respect to the following figures.

DETAILED DESCRIPTION

Illustrated is a system and method to activate an alarm where a mobile computing device is no longer proximate to a docking station that provides inductive charging and data transfer capabilities for the mobile computing device. An alarm, as used herein, is visual and/or audible indicia of an event. Example visual indicia are an illuminated Light Emitting Diode (LED). An example of audible indicia is a human detectable sound (e.g., a sound between 20 Hz and 20,000 Hz). This human detectable sound may be constant, intermittent, and may vary in terms of pitch and tone. An example of an event is the removal of a mobile computing device from a docking station that provides inductive charging and/or data transfer capabilities. An example of a docking station that provides inductive charging and data transfer capabilities (referenced herein as a "docking station") for the mobile computing device is provide in U.S. patent application Ser. No. 12/239,656 titled "Orientation and Presence Detection For Use in Configuring Operations of Computing Devices In Docked Environments."

In one example embodiment, a mobile computing device is determined to be no longer proximate to a docking station such that an alarm is activated. Specifically, in cases where a mobile computing device is determined to be no longer proximate to a docking station, the alarm logic is executed to activate an alarm. In some example embodiments, the alarm is activated where the mobile computing device is no longer proximate to another computer system, smart phone, slate computer, printer, display or other suitable device. The proximity sensor determines that the mobile computing device is proximate to the docketing station, and where such a determination is made the alarm is set. The proximity sensor may use one or more of the following method to set the alarm: a magnetically based proximity switch, a mechanical switch, an acoustic sensor, a Hall-Effect Sensor, an IR Sensor, or some other suitable sensor. To set, as used herein, may include closing or opening an electrical circuit, initializing a numeric or Boolean value in a memory, or some other suitable process. When the mobile computing device is removed from the docking station (i.e., the mobile computing device is no longer proximate to the docking station), the proximity sensor is de-activated and the alarm is activated. The alarm may be activated by the closing or opening of an electrical circuit, initializing a numeric or Boolean value in a memory, or some other suitable process. The aforementioned visual or audible indicia may emanate from the docketing station, the mobile computing device or both the docketing station and mobile computing device. In some example embodiments, the determination of mobile computing device proximity is carried out by a docking station processor executing logic stored in memory on the docking station.

Figure 1A:
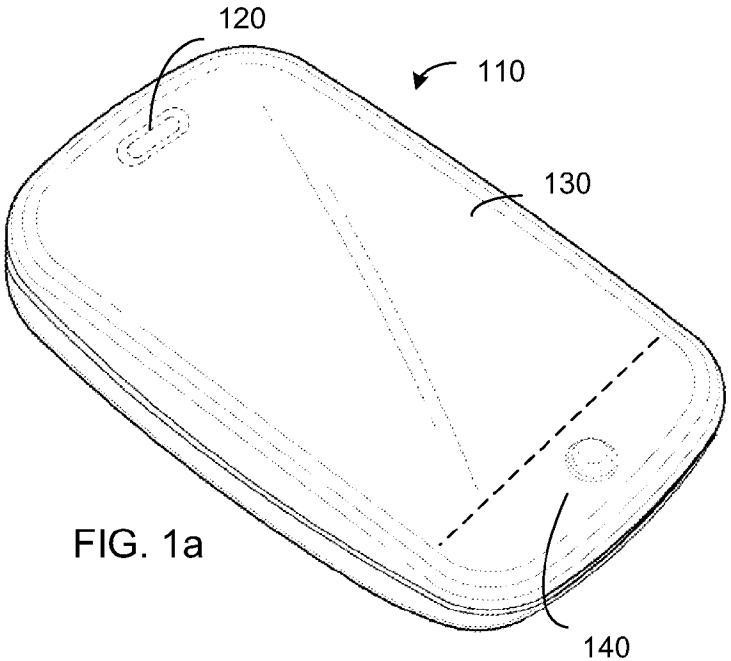
FIG. 1*a* illustrates one example embodiment of a mobile computing device that is placed proximate to a docking station.
Figure 1B:
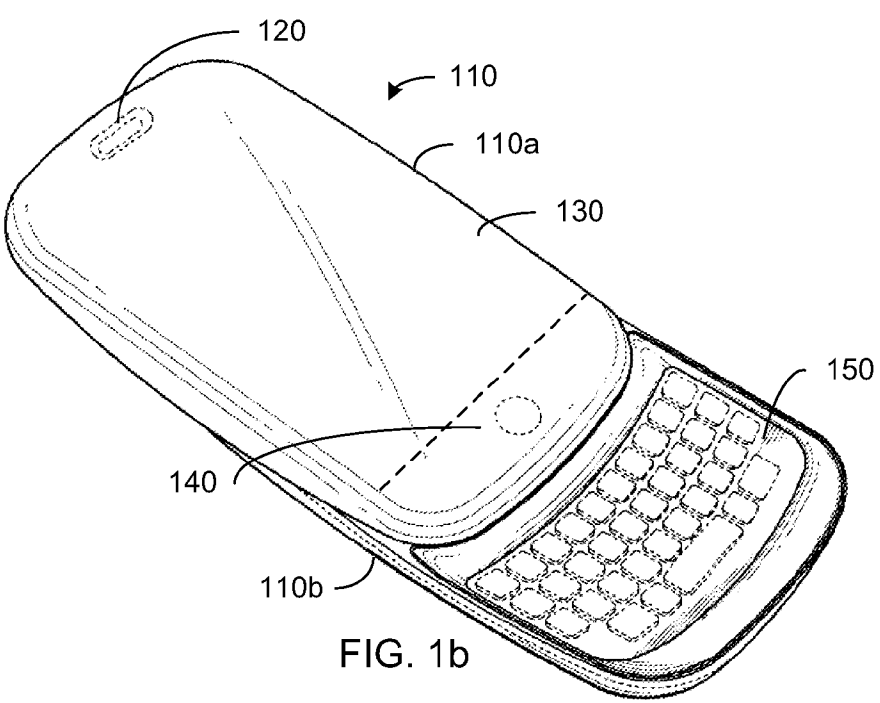
FIG. 1*b* illustrates one example embodiment of a mobile computing device that is placed proximate to a docking station.

FIGS. 1*a* and 1*b* illustrate one embodiment of a mobile computing device 110 that is placed proximate to a docking station. FIG. 1*a* illustrates one embodiment of a first positional state of the mobile computing device 110 having telephonic functionality, e.g., a mobile phone or smartphone. FIG. 1*b* illustrates one embodiment of a second positional state of the mobile computing device 110 having telephonic functionality, e.g., a mobile phone, slate device, smartphone, netbook, or laptop computer. The mobile computing device 110 is configured to host and execute a phone application for placing and receiving telephone calls. In one example embodiment, the configuration as disclosed may be configured for use between a mobile computing device, that may be host device, and an accessory device.

It is noted that for ease of understanding the principles disclosed herein are in an example context of a mobile computing device 110 with telephonic functionality operating in a mobile telecommunications network. However, the principles disclosed herein may be applied in other duplex (or multiplex) telephonic contexts such as devices with telephonic functionality configured to directly interface with Public Switched Telephone Networks (PSTN) and/or data networks having Voice over Internet Protocol (VoIP) functionality. Likewise, the mobile computing device 110 is only by way of example, and the principles of its functionality apply to other computing devices, e.g., desktop computers, slate devices, server computers and the like.

The mobile computing device 110 includes a first portion 110*a* and a second portion 110*b*. The first portion 110*a* comprises a screen for display of information (or data) and may include navigational mechanisms. These aspects of the first portion 110*a* are further described below. The second portion 110*b* comprises a keyboard and also is further described below. The first positional state of the mobile computing device 110 may be referred to as an "open" position, in which the first portion 110*a* of the mobile computing device slides in a first direction exposing the second portion 110*b* of the mobile computing device 110 (or vice versa in terms of movement). The mobile computing device 110 remains operational in either the first positional state or the second positional state.

The mobile computing device 110 is configured to be of a form factor that is convenient to hold in a user's hand, for example, a Personal Digital Assistant (PDA) or a smart phone form factor. For example, the mobile computing device 110 can have dimensions ranging from 7.5 to 15.5 centimeters in length, 5 to 15 centimeters in width, 0.5 to 2.5 centimeters in thickness and weigh between 50 and 250 grams.

The mobile computing device 110 includes a speaker 120, a screen 130, and an optional navigation area 140 as shown in the first positional state. The mobile computing device 110 also includes a keypad 150, which is exposed in the second positional state. The mobile computing device also includes a microphone (not shown). The mobile computing device 110 also may include one or more switches (not shown). The one or more switches may be buttons, sliders, or rocker switches and can be mechanical or solid state (e.g., touch sensitive solid state switch). The aforementioned alarm may emanate from the speaker 120.

The screen 130 of the mobile computing device 110 is, for example, a 240×240, a 320×320, a 320×480, or a 640×480 touch sensitive (including gestures) display screen. The screen 130 can be structured from, for example, such as glass, plastic, thin-film or composite material. In one embodiment the screen may be 1.5 inches to 5.5 inches (or 4 centimeters to 14 centimeters) diagonally. The touch sensitive screen may be a transflective liquid crystal display (LCD) screen. In alternative embodiments, the aspect ratios and resolution may be different without departing from the principles of the inventive features disclosed within the description. By way of example, embodiments of the screen 130 comprises an active matrix liquid crystal display (AMLCD), a thin-film transistor liquid crystal display (TFT-LCD), an organic light emitting diode (OLED), an Active-matrix OLED (AMOLED), an interferometric modulator display (IMOD), a liquid crystal display (LCD), or other suitable display device. In an embodiment, the display displays color images. In another embodiment, the screen 130 further comprises a touch-sensitive display (e.g., pressure-sensitive (resistive), electrically sensitive (capacitive), acoustically sensitive (SAW or surface acoustic wave), photo-sensitive (infra-red)) including a digitizer for receiving input data, commands or information from a user. The user may use a stylus, a finger or another suitable input device for data entry, such as selecting from a menu or entering text data.

The optional navigation area 140 is configured to control functions of an application executing in the mobile computing device 110 and visible through the screen 130. For example, the navigation area includes an x-way (x is a numerical integer, e.g., 5) navigation ring that provides cursor control, selection, and similar functionality. In addition, the navigation area may include selection buttons to select functions displayed through a user interface on the screen 130. In addition, the navigation area also may include dedicated function buttons for functions such as, for example, a calendar, a web browser, an e-mail client or a home screen. In this example, the navigation ring may be implemented through mechanical, solid state switches, dials, or a combination thereof. In an alternate embodiment, the navigation area 140 may be configured as a dedicated gesture area, which allows for gesture interaction and control of functions and operations shown through a user interface displayed on the screen 130.

The keypad area 150 may be a numeric keypad (e.g., a dialpad) or a numeric keypad integrated with an alpha or alphanumeric keypad or character keypad 150 (e.g., a keyboard with consecutive keys of Q-W-E-R-T-Y, A-Z-E-R-T-Y, or other equivalent set of keys on a keyboard such as a DVORAK keyboard or a double-byte character keyboard).

Although not illustrated, it is noted that the mobile computing device 110 also may include an expansion slot. The expansion slot is configured to receive and support expansion cards (or media cards). Examples of memory or media card form factors include COMPACT FLASH, SD CARD, XD CARD, MEMORY STICK, MULTIMEDIA CARD, SDIO, and the like.

Figure 2A:
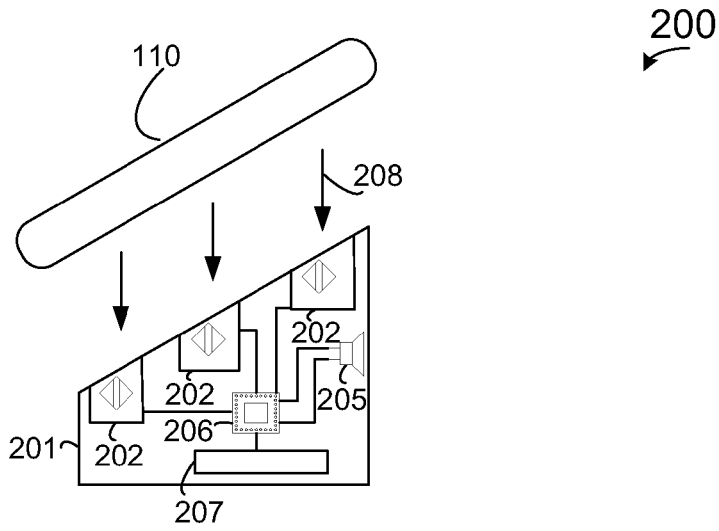
FIG. 2*a* is a diagram of a system, according to an example embodiment, illustrating the placement of the mobile computing device 110 to be proximate to a docketing station 201.

FIG. 2*a* is a diagram of a system 200 illustrating the example placement of the mobile computing device 110 to be proximate to a docketing station 201. Shown is the mobile computing device 110 that is placed to reside on the docketing station 201. This placement is illustrated at 208. The docking station 201 includes a number of components including a plurality of proximity sensors 202. While a plurality of sensors is illustrated, one sensor may be used in lieu of a plurality of proximity sensors 202. The proximity sensors 202 are operatively connected to a processor 206. Operatively connected, as used herein, includes a logical or physical connected. The processor 206 is operatively connected to a speaker 205 and an alarm logic module 207. The speaker 205 is used to generate an audible indicia of an event such as the removal of the mobile computing device 110 from the docking station 201. The alarm logic module may be memory upon which logic or instructions executable by the processor 206 reside.

Figure 2B:
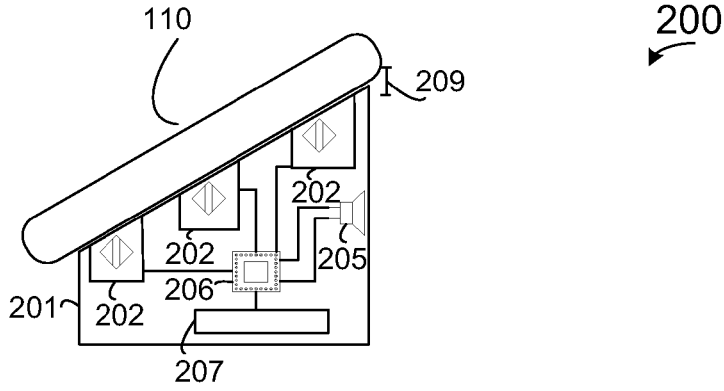
FIG. 2*b* is a diagram of a system, according to an example embodiment, illustrating the example placement of the mobile computing device proximate to the docketing station.

FIG. 2*b* is a diagram of the system 200 illustrating the example placement of the mobile computing device 110 proximate to the docketing station 201. In cases where the mobile computing device 110 is proximate to the docking station 201, an alarm may be set. To set, as used herein, may include closing or opening an electrical circuit, initializing a numeric or Boolean value in a memory, or some other suitable process. The proximate nature of the mobile computing device 110 and the docking station 201 is reflected at 209. An example of proximate is between 0-2 mm distance between the mobile computing device 110 and the docking station 201.

Figure 2C:
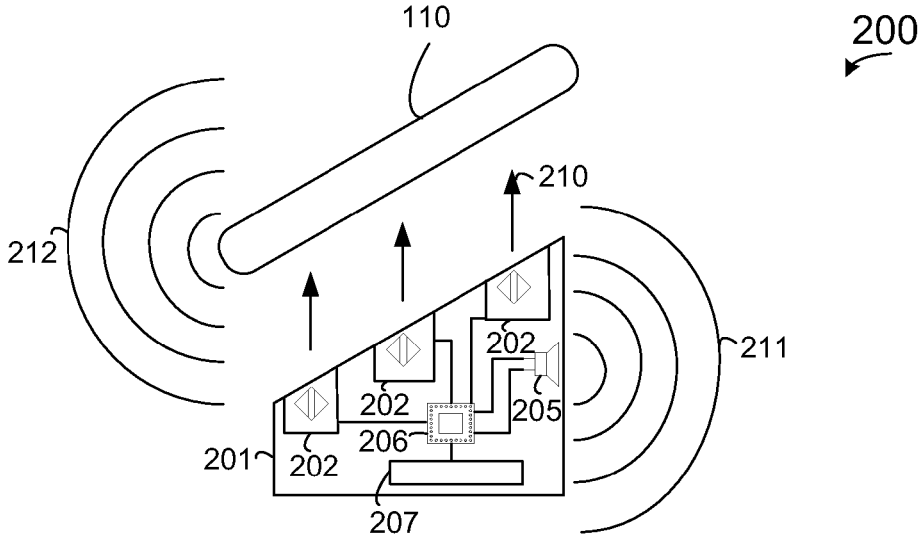
FIG. 2*c* is a diagram of the system, according to an example embodiment, illustrating an case where the mobile computing device is no longer proximate to the docketing station resulting in the activation of the alarm.

FIG. 2*c* is a diagram of the system 200 illustrating an example case where the mobile computing device 110 is no longer proximate to the docketing station 201 resulting in the activation of the alarm. Illustrated at 210 is the removal of the mobile computing device 110 from the docking station 201. This removal results in the mobile computing device 110 no longer being proximate to the docketing station 201. As will be discussed in more detail below, one or more of the sensors 202 detect that the mobile computing device 110 is no longer proximate to the docking station 201. The event of the removal of the mobile computing device, triggers an audible or visual indicia in the form of an alarm. The alarm itself may be activated by the closing or opening of an electrical circuit, initializing a numeric or Boolean value in a memory, or some other suitable process. An audible indicia in the form of a sound generated by the speaker 205 is shown at 211. An additional audible indicia in the form of sound generated by the mobile computing device 110, and a speaker 120 associated therewith, is shown at 212. The audible indicia illustrated at 211 and 212 may be generated separately or in combination.

Figure 3:
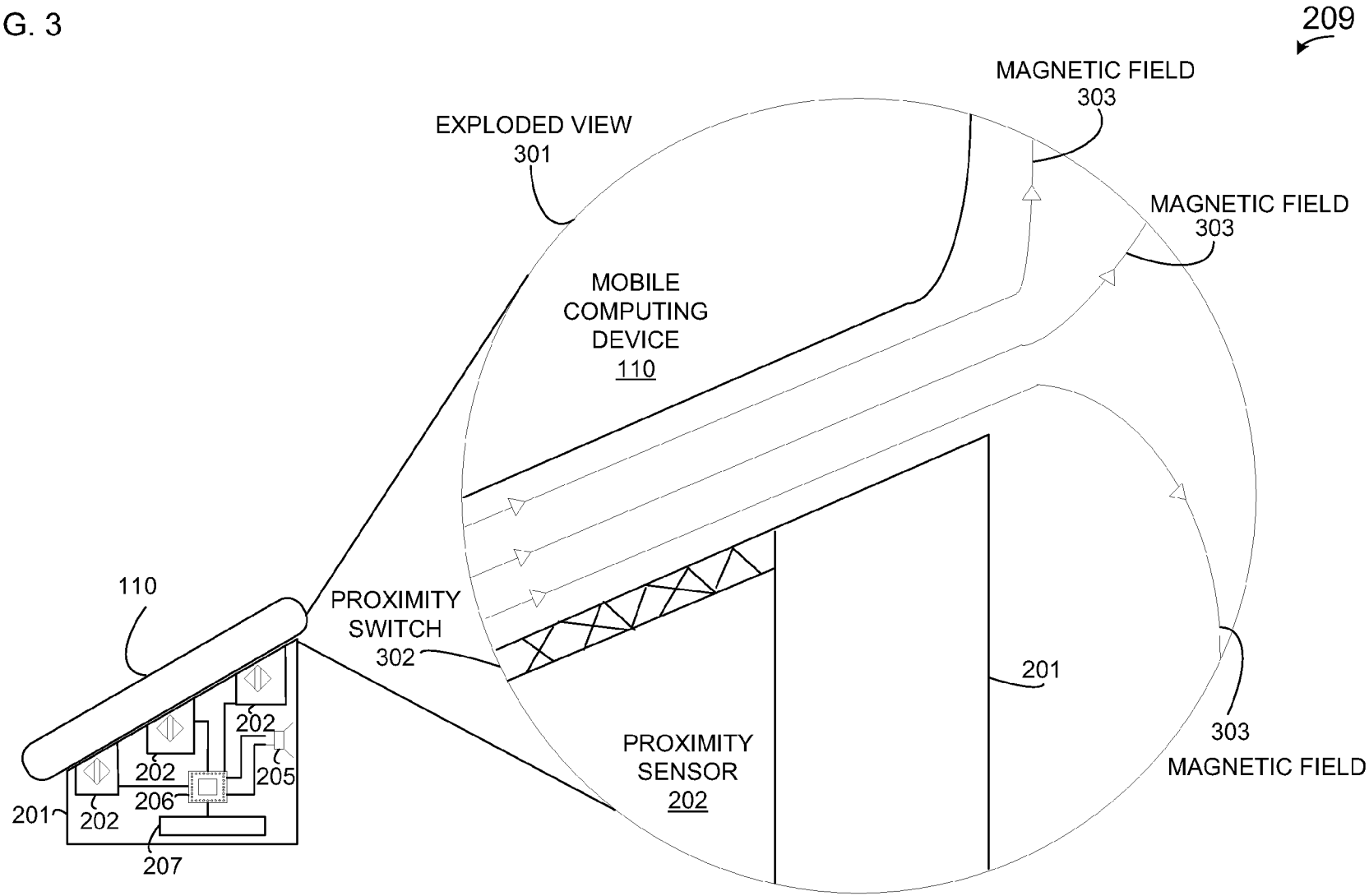
FIG. 3 illustrates the proximate nature of the mobile computing device and the docking station, according to an example embodiment, and the use of one or more magnetic sensors to determine this proximity.

FIG. 3 illustrates the proximate nature of the mobile computing device 110 and the docking station 201, and the use of one or more magnetic sensors to determine this proximity. Shown is an exploded view 301 of the proximate nature of the mobile computing device 110 and the docking station 201 as reflected at 209. Within this exploded view 301, is a proximity switch 302 that is part of the proximity sensor 202. This proximity switch 302 detects magnetic fields 303, and where a plurality of magnetic fields is detected, the mobile device 110 is determined to be proximate to the docking station 201. As will be discussed in more detail below, this determination of proximity results in the setting of the alarm via the closing or opening an electrical circuit, initializing a numeric or Boolean value in a memory, or some other suitable process.

Figure 4:
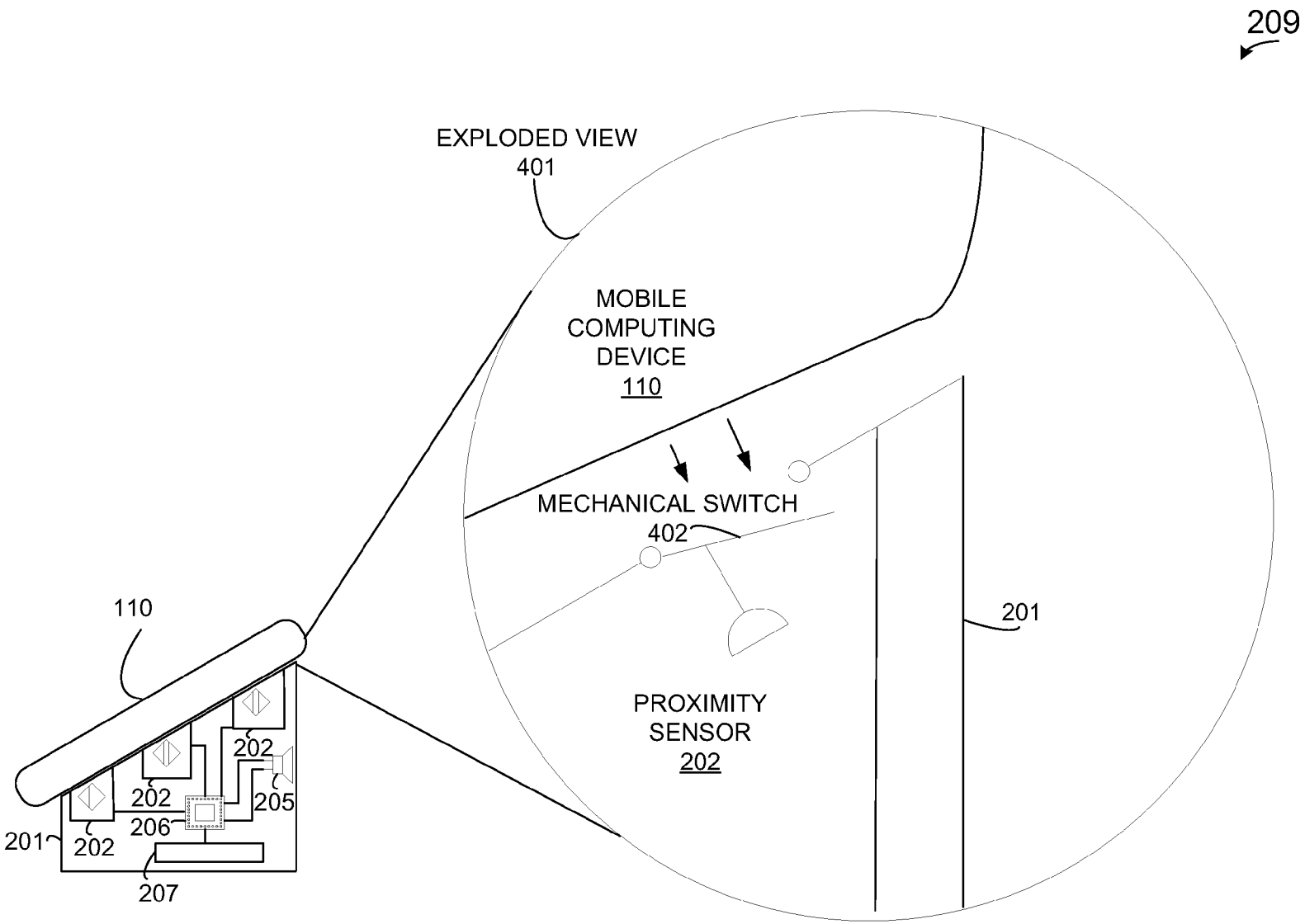
FIG. 4 illustrates the proximate nature of the mobile computing device and the docking station, according to an example embodiment, and the use of one or more mechanical switches to determine this proximity.

FIG. 4 illustrates the proximate nature of the mobile computing device 110 and the docking station 201, and the use of one or more mechanical switches to determine this proximity. Shown is an exploded view 401 of the proximate nature of the mobile computing device 110 and the docking station 201 as reflected at 209. Within this exploded view 401, is a mechanical switch 402 that is part of the proximity sensor 202. In instances where the mechanical switch is activated, the mobile device 110 is determined to be proximate to the docking station 201. Activation of the mechanical switch 402 may take the form of the depression of a physical button by the mobile computing device 110, or via some other suitable mechanical operation. As will be discussed in more detail below, this determination of proximity results in the setting of the alarm via the closing or opening an electrical circuit, initializing a numeric or Boolean value in a memory, or some other suitable process.

Figure 5:
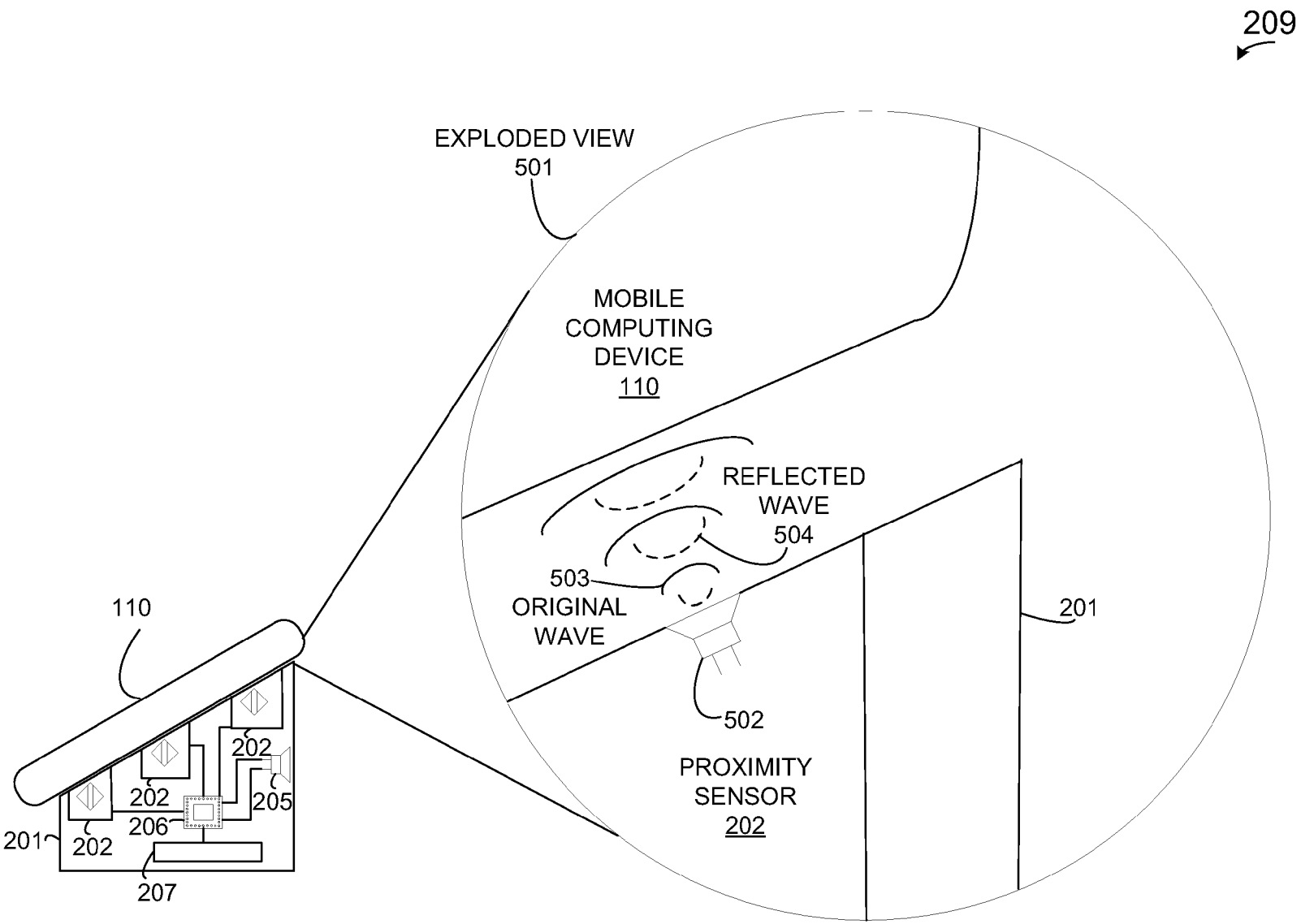
FIG. 5 illustrates the proximate nature of the mobile computing device and the docking station, according to an example embodiment, and the use of one or more acoustic sensors to determine this proximity.

FIG. 5 illustrates the proximate nature of the mobile computing device 110 and the docking station 201, and the use of one or more acoustic sensors to determine this proximity. Shown is an exploded view 501 of the proximate nature of the mobile computing device 110 and the docking station 201 as reflected at 209. Shown within this exploded view 301, is an acoustic sensor 502 that is part of the proximity sensor 202. This acoustic sensor 502 may be an ultrasonic sender/receiver that detects the proximity of the mobile computing device 110 via the use of ultrasonic original waves 503 and reflected waves 504. The more frequent and intense the reflected waves 504, the more proximate the mobile computing device 110 to the docking station 201. In some example embodiments, a baseline reflected wave value is set to identify the mobile computing device 110 as being proximate, such that where the baseline reflected wave value is met by the reflected wave value the mobile computing device 110 is deemed proximate. As will be discussed in more detail below, this determination of proximity results in the setting of the alarm via the closing or opening an electrical circuit, initializing a numeric or Boolean value in a memory, or some other suitable process.

Figure 6:
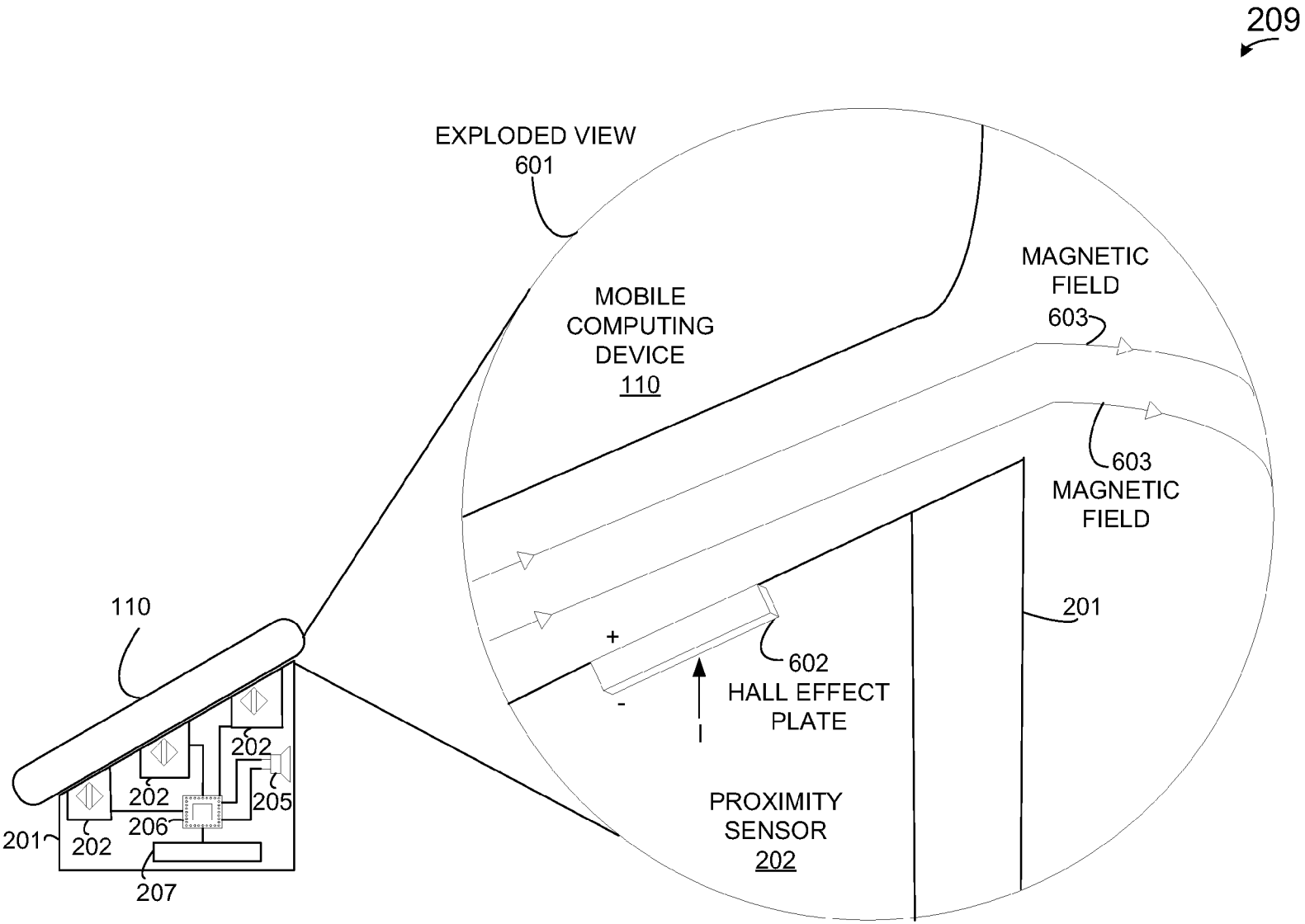
FIG. 6 illustrates the proximate nature of the mobile computing device and the docking station, according to an example embodiment, and the use of one or more Hall-Effect sensors to determine this proximity.

FIG. 6 illustrates the proximate nature of the mobile computing device 110 and the docking station 201, and the use of one or more Hall-Effect sensors to determine this proximity. Shown is an exploded view 601 of the proximate nature of the mobile computing device 110 and the docking station 201 as reflected at 209. Within this exploded view 601, is a Hall-Effect plate 602 that is part of the proximity sensor 202. In some example embodiments, a current "I" is provided to the Hall-Effect plate 602, such that "I" is perpendicular to the magnetic fields 603. A charge accumulates on the Hall-Effect plate 602 such that proximity can be determined. For example, the larger the charge the closer to mobile computing device 110 is to the docking station 201. As will be discussed in more detail below, this determination of proximity results in the setting of the alarm via the closing or opening an electrical circuit, initializing a numeric or Boolean value in a memory, or some other suitable process.

Figure 7:
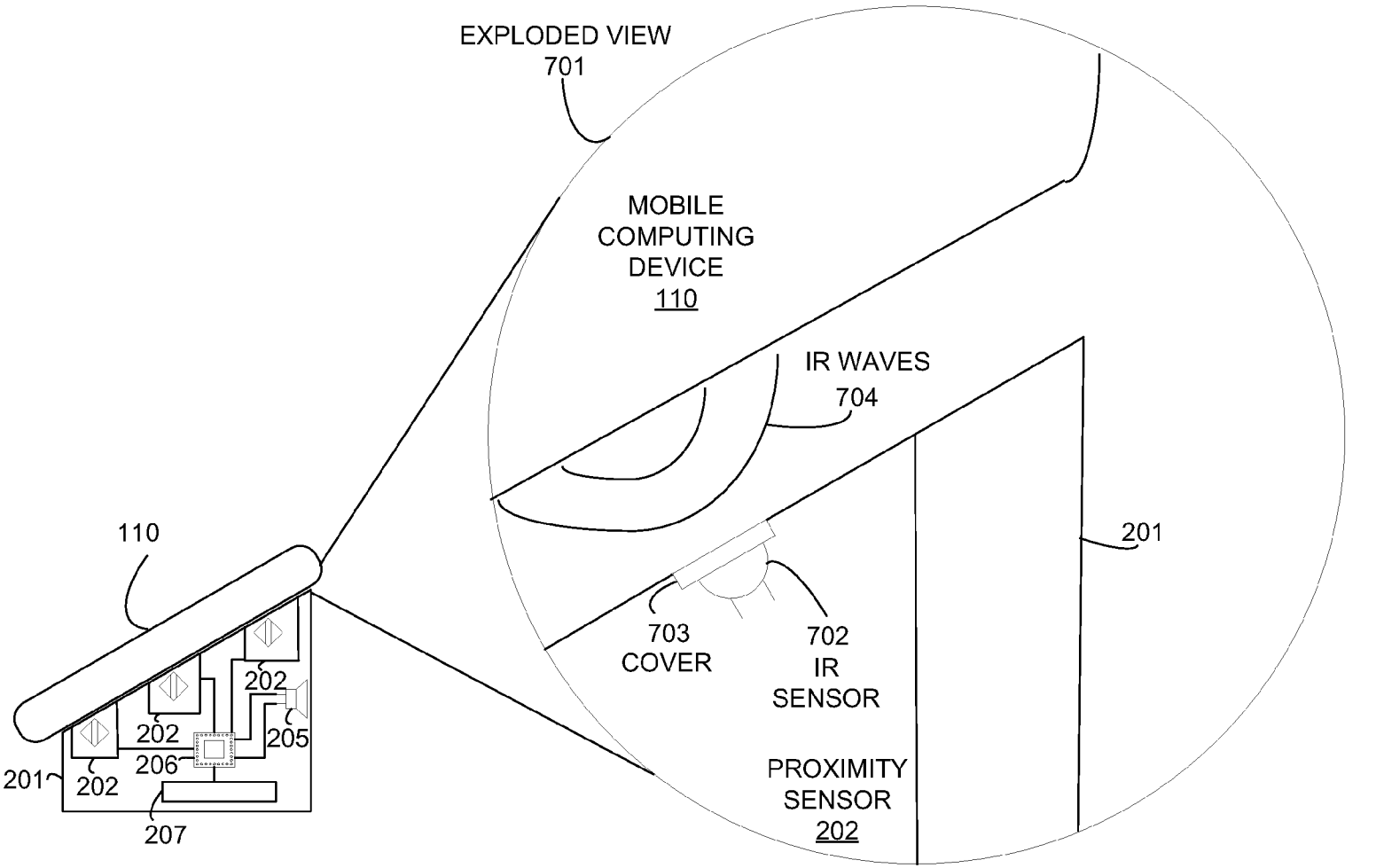
FIG. 7 illustrates the proximate nature of the mobile computing device and the docking station, according to an example embodiment, and the use of one or more Infra-Red (IR) sensors to determine this proximity.

FIG. 7 illustrates the proximate nature of the mobile computing device 110 and the docking station 201, and the use of one or more IR sensors to determine this proximity. Shown is an exploded view 701 of the proximate nature of the mobile computing device 110 and the docking station 201 as reflected at 209. Within this exploded view 701, is an IR sensor 702 and cover 703 that is part of the proximity sensor 202. The IR sensor 702 may be an active or passive IR sensor. The cover 703 may be a Fresnel lense used to focus the IR waves 704, and to keep contaminates away from the IR sensor 702. In some example embodiments, a baseline IR wave value is set to identify the mobile computing device 110 as being proximate, such that where the baseline reflected wave value is met by the values associated with the IR waves 704 the mobile computing device 110 is deemed proximate. As will be discussed in more detail below, this determination of proximity results in the setting of the alarm via the closing or opening an electrical circuit, initializing a numeric or Boolean value in a memory, or some other suitable process.

Figure 8:
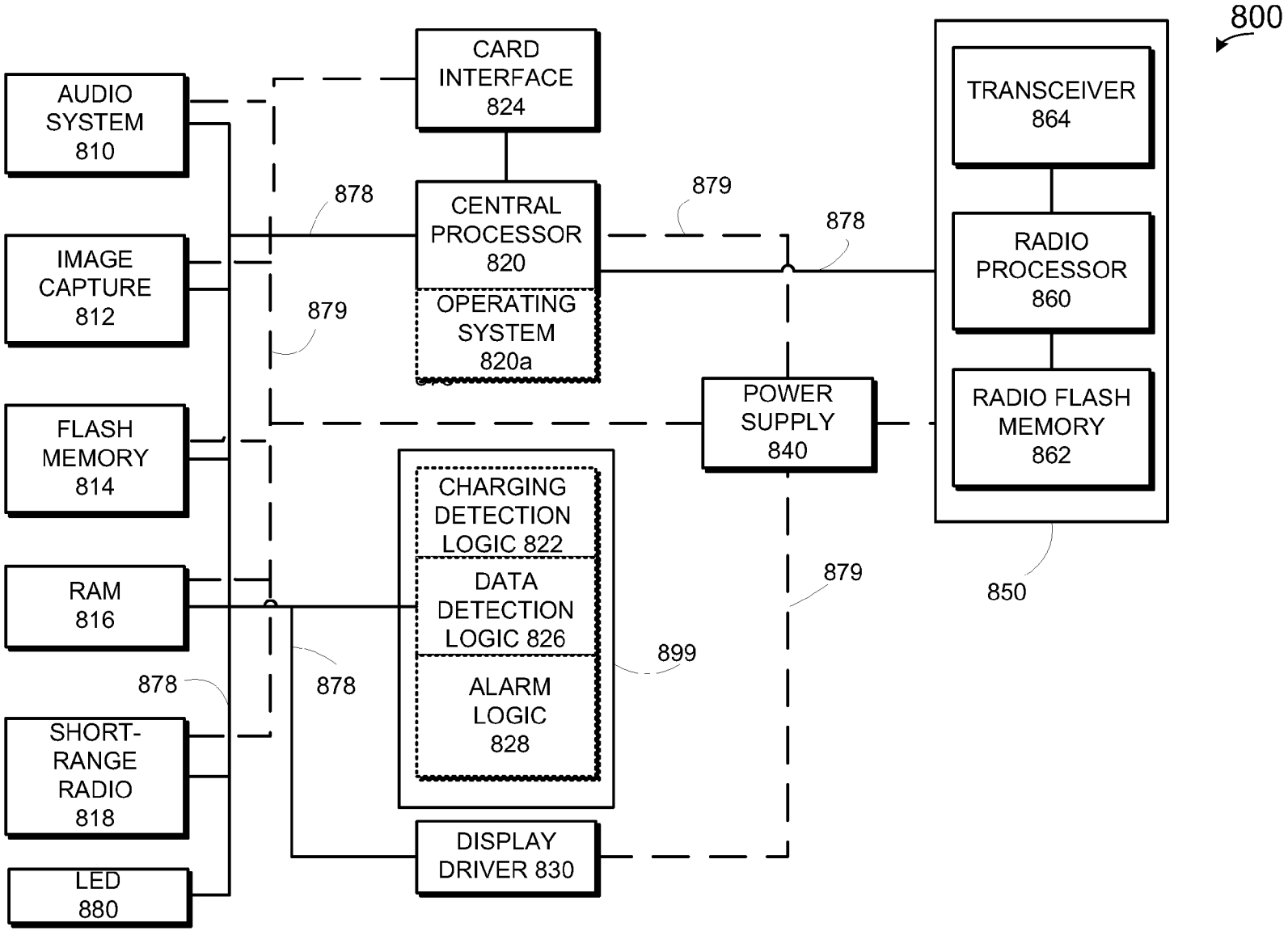
FIG. 8 is a block diagram illustrating an architecture, according to an example embodiment, of a mobile computing device enabled to generate an alarm when the mobile computing device is no longer proximate to a docketing station.

Referring next to FIG. 8, a block diagram illustrates an example architecture of a mobile computing device 110, enabled to generate an alarm when the mobile computing device is no longer proximate to a docketing station 201. By way of example, the architecture illustrated in FIG. 8 will be described with respect to the mobile computing device of FIGS. 1*a*, and 1*b*. The mobile computing device 110 includes a central processor 820, a power supply 840, and a radio subsystem 850. Examples of a central processor 820 include processing chips and system based on architectures such as ARM (including cores made by microprocessor manufacturers), ARM XSCALE, QUALCOMM SNAPDRAGON, AMD ATHLON, SEMPRON or PHENOM, INTEL ATOM, XSCALE, CELERON, CORE, PENTIUM or ITANIUM, IBM CELL, POWER ARCHITECTURE, SUN SPARC and the like.

The central processor 820 is configured for operation with a computer operating system 820*a*. The operating system 820*a* is an interface between hardware and an application, with which a user typically interfaces. The operating system 820*a* is responsible for the management and coordination of activities and the sharing of resources of the mobile computing device 110. The operating system 820*a* provides a host environment for applications that are run on the mobile computing device 110. As a host, one of the purposes of an operating system is to handle the details of the operation of the mobile computing device 110. Examples of an operating system include PALM OS and WEBOS, MICROSOFT WINDOWS (including WINDOWS 7, WINDOWS CE, and WINDOWS MOBILE), SYMBIAN OS, RIM BLACKBERRY OS, APPLE OS (including MAC OS and IPHONE OS), GOOGLE ANDROID, and LINUX.

The central processor 820 communicates with an audio system 810, an image capture subsystem (e.g., camera, video or scanner) 812, flash memory 814, RAM memory 816, and a short range radio module 818 (e.g., Bluetooth, Wireless Fidelity (WiFi) component (e.g., IEEE 802.11, 802.20, 802.15, 802.16)). The central processor 820 communicatively couples these various components or modules through a data line (or bus) 878. The power supply 840 powers the central processor 820, the radio subsystem 850 and a display driver 830 (which may be contact- or inductive-sensitive). The power supply 840 may correspond to a direct current source (e.g., a battery pack, including rechargeable) or an alternating current (AC) source. The power supply 840 powers the various components through a power line (or bus) 879.

The central processor communicates with applications executing within the mobile computing device 110 through the operating system 820*a*. In addition, intermediary components, for example, a charging detection logic 822 and data detection logic 826, provide additional communication channels between the central processor 820 and operating system 820 and system components, for example, the display driver 830.

It is noted that in one embodiment, central processor 820 executes logic (e.g., by way of programming, code, or instructions) corresponding to executing applications interfaced through, for example, the navigation area 140 or switches. It is noted that numerous other components and variations are possible to the hardware architecture of the computing device 800, thus an embodiment such as shown by FIG. 8 is just illustrative of one implementation for an embodiment.

In one example embodiment, the charging detection logic 822 and data detection logic 826 is used to determine whether the mobile computing device 110 is being charged and/or is receiving or transmitting data. In cases where the mobile computing device 110 is no longer being charged or is no longer receiving or transmitting data the alarm logic 828 is executed and a visual or audible indicia is executed. As discussed above, the audible indicia may be generated using the speaker 120 that is operatively connected to the audio system 810 and alarm logic 828. Further, the visual indicia may be generated using an LED 880 that is operatively connected to the display driver 830 and alarm logic 828. The charging detection logic 822, data detection logic 826, and alarm logic 828 may reside as part of a module 899.

The radio subsystem 850 includes a radio processor 860, a radio memory 862, and a transceiver 864. The transceiver 864 may be two separate components for transmitting and receiving signals or a single component for both transmitting and receiving signals. In either instance, it is referenced as a transceiver 864. The receiver portion of the transceiver 864 communicatively couples with a radio signal input of the device 110, e.g., an antenna, where communication signals are received from an established call (e.g., a connected or on-going call). The received communication signals include voice (or other sound signals) received from the call and processed by the radio processor 860 for output through the speaker 120. The transmitter portion of the transceiver 864 communicatively couples a radio signal output of the device 110, e.g., the antenna, where communication signals are transmitted to an established (e.g., a connected (or coupled) or active) call. The communication signals for transmission include voice, e.g., received through the microphone of the device 110, (or other sound signals) that is processed by the radio processor 860 for transmission through the transmitter of the transceiver 864 to the established call.

In one embodiment, communications using the described radio communications may be over a voice or data network. Examples of voice networks include Global System of Mobile (GSM) communication system, a Code Division, Multiple Access (CDMA system), and a Universal Mobile Telecommunications System (UMTS). Examples of data networks include General Packet Radio Service (GPRS), third-generation (3G) mobile (or greater), High Speed Download Packet Access (HSDPA), High Speed Uplink Packet Access (HSUPA), and Worldwide Interoperability for Microwave Access (WiMAX).

While other components may be provided with the radio subsystem 850, the basic components shown provide the ability for the mobile computing device to perform radio-frequency communications, including telephonic communications. In an embodiment, many, if not all, of the components under the control of the central processor 820 are not required by the radio subsystem 850 when a telephone call is established, e.g., connected or ongoing. The radio processor 860 may communicate with central processor 820 using the data line (or bus) 878.

The card interface 824 is adapted to communicate, wirelessly or wired, with external accessories (or peripherals), for example, media cards inserted into the expansion slot (not shown). The card interface 824 transmits data and/or instructions between the central processor and an accessory, e.g., an expansion card or media card, coupled within the expansion slot. The card interface 824 also transmits control signals from the central processor 820 to the expansion slot to configure the accessory. It is noted that the card interface 824 is described with respect to an expansion card or media card; it also may be structurally configured to couple with other types of external devices for the device 110, for example, an inductive charging station (i.e., a docking station 201) for the power supply 840 or a printing device.

Figure 9:
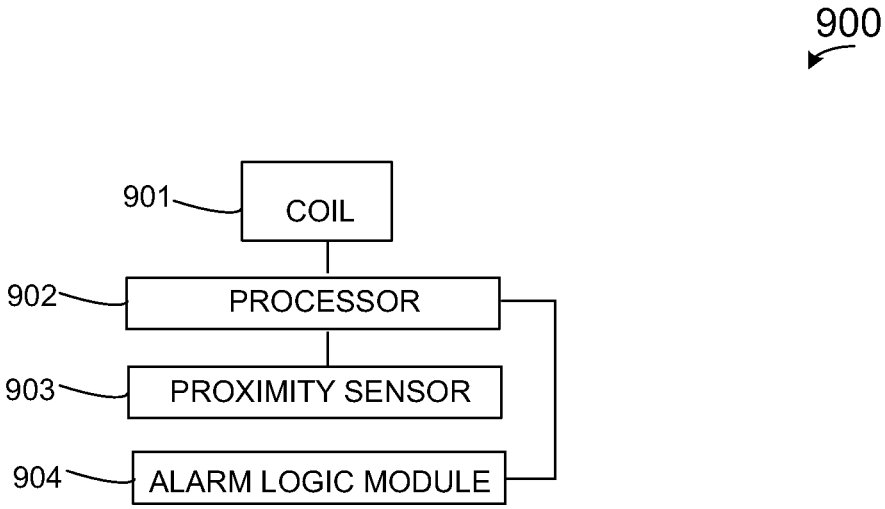
FIG. 9 is a block diagram for a computing device, according to an example embodiment, used to activate an alarm where a mobile computing device is no longer proximate to the computing device, the computing device to provide inductive charging and data transfer capabilities for the mobile computing device.

FIG. 9 is a block diagram for a computing device 900 used to activate an alarm where a mobile computing device is no longer proximate to the computing device 900, the computing device 900 to provide inductive charging and data transfer capabilities for the mobile computing device. The various blocks illustrated herein may be implemented in hardware, firmware, or software, and may be operatively connected. Shown is a coil 901 to provide inductive charging for a mobile computing device. In some example embodiments, a plurality of coils 901 is implemented. Operatively connected to the coil 901 is a processor 902 to control the inductive charging of the mobile computing device. Operatively connected to the processor 902 is a proximity sensor 903, the proximity sensor 903 to determine that the mobile computing device is proximate to the computer system 900. Operatively connected to the processor 902 is an alarm logic module 904 to activate an alarm when the mobile computing device is no longer proximate to the computer system 900. In some example embodiments, the computer system 900 includes at least one of a docking station, smart phone, slate computer, printer, or display. In some example embodiments, the proximity sensor 903 includes are least one of a proximity switch, a mechanical switch, an acoustic sensor, a Hall-Effect sensor, or an IR sensor. In some example embodiments, the alarm is at least one of a visual or audible indicia. In some example embodiments, proximate is between 0-2 mm in distance.

Figure 10:
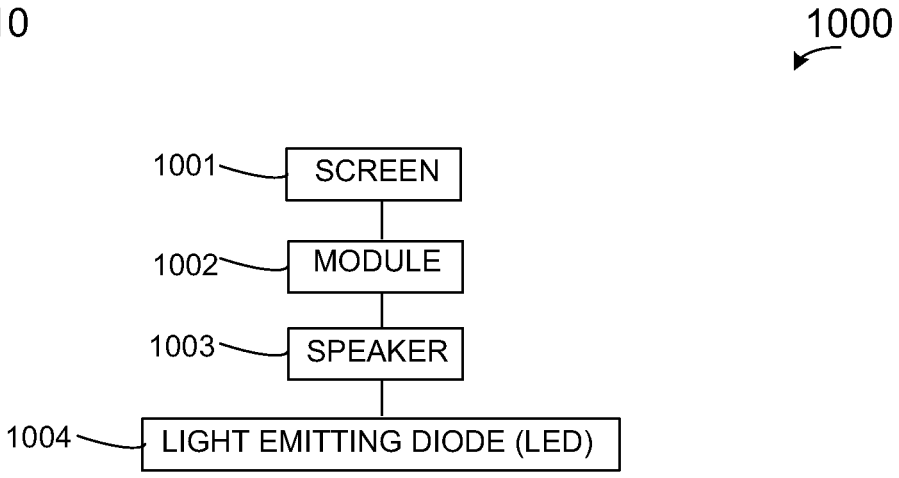
FIG. 10 is a block diagram for a mobile computing device, according to an example embodiment, used to activate an alarm where a mobile computing device is no longer proximate to a computing device, the mobile computing device capable of receiving an inductive charge.

FIG. 10 is a block diagram for a mobile computing device 1000 used to activate an alarm where a mobile computing device is no longer proximate to a computing device, the mobile computing device 1000 capable of receiving an inductive charge. The mobile computing device 110 is an example of the mobile computing device 1000. The various blocks illustrated herein may be implemented in hardware, firmware, or software, and may be operatively connected. Shown is a screen 1001 to receive input to activate proximity detection, the proximity detection activated when the mobile computing device 1000 is to receive an inductive charge. The screen 130 is an example of the screen 1001. Operatively connected to the screen 1001 is a module 1002 to determine that the mobile computing device is no longer receiving the inductive charge. The charging detection logic 822 is an example of the module 1002. Operatively connected to the module 1002 is a speaker 1003 to generate an audible indicia when the mobile computing device is no longer receiving the inductive charge. Speaker 120 is an example of the speaker 1003. Operatively connected to the module 1002 is an LED 1004 to generate a visual indicia when the mobile computing device is no longer receiving the inductive charge. LED 880 is an example of LED 1004. In some example embodiments, the module 1002 determines that the mobile computing device is no longer receiving data. In some example embodiments, the proximity detection includes setting a Boolean value denoting that the mobile computing device is to receive the inductive charge. In some example embodiments, the module 1002 sets the Boolean value to denote that the mobile computing device is no longer receiving the inductive charge.

Figure 11:
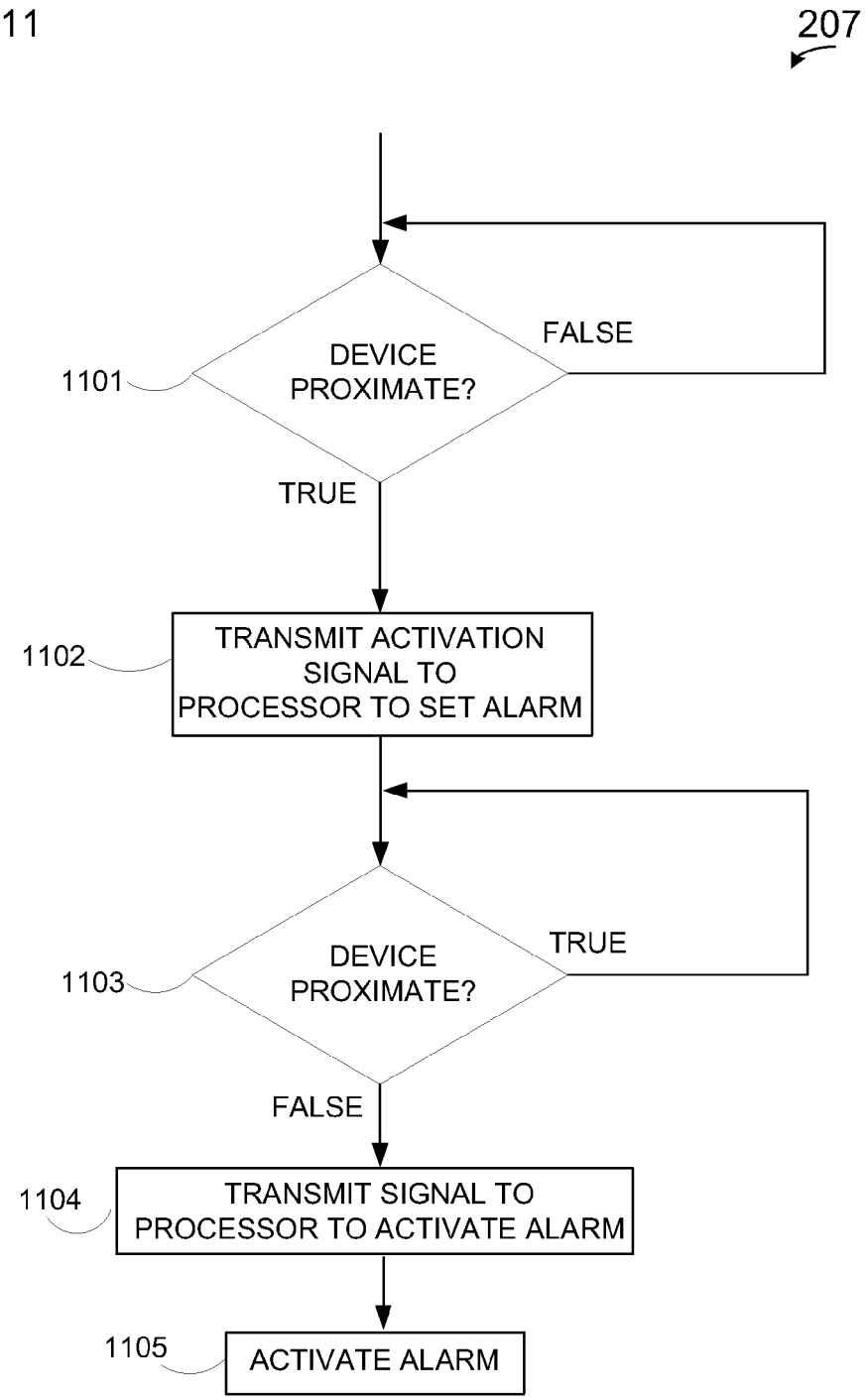
FIG. 11 is a flow chart illustrating a method, according to an example embodiment, associated with an alarm logic module to activate an alarm where a mobile computing device is no longer proximate to a docking station.

FIG. 11 is a flow chart illustrating an example method associated with an alarm logic module 207 to activate an alarm where a mobile computing device is no longer proximate to a docking station. Shown is a decision operation 1101 executed to determine whether a mobile computing device 110 is proximate to the docketing station 201. Proximity of the mobile computing device 110 to the docking station 201 is determined through the use of one or more of the proximity sensors 202 illustrated in FIGS. 3-7. In cases where decision operation 1101 evaluates to "false," decision operation 1101 is re-executed. In cases where decision operation 1101 evaluates to "true," operation 1102 is executed. Operation 1102 is executed to transmit an activation signal to the processor 206 to set the alarm. As discussed above, the setting of the alarm may include the closing or opening an electrical circuit, initializing a numeric or Boolean value in a memory, or some other suitable process. Decision operation 1103 is executed to determine whether a mobile computing device 110 is proximate to the docketing station 201. Proximity of the mobile computing device 110 to the docking station 201 is determined through the use of one or more of the proximity sensors 202 illustrated in FIGS. 3-7. In cases where decision operation 1103 evaluates to "true," decision operation 1101 is re-executed. In cases where decision operation 1101 evaluates to "false," operation 1104 is executed. Operation 1104 is executed to transmit a signal from the proximity sensor 202 to the processor 206 to activate the alarm. Activating the alarm may include the closing or opening an electrical circuit, initializing a numeric or Boolean value in a memory, or some other suitable process. Operation 1105 is executed to activate the alarm such that the speaker 250 generates audible indicia as shown at 211. In some example embodiments, a visual indicia may be generated by the docking station 201, where the alarm is activated through the execution of the operation 1105.

Figure 12:
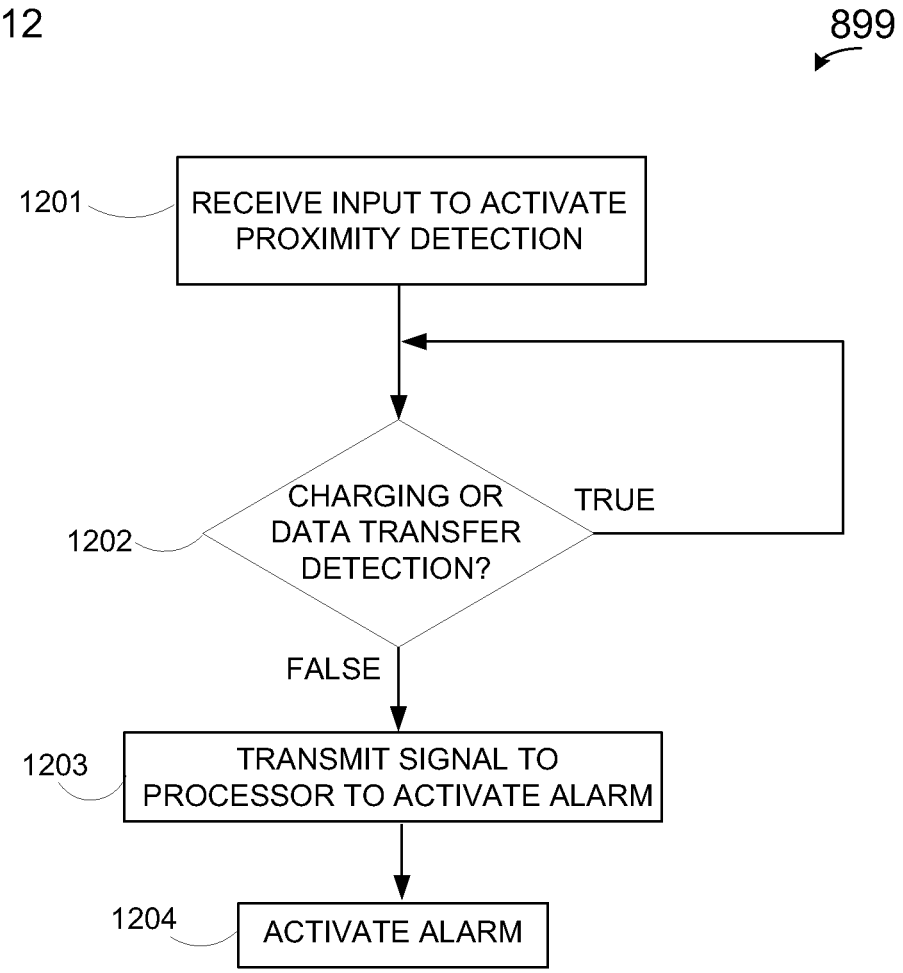
FIG. 12 is a flow chart illustrating a module, according to an example embodiment, executed by the mobile computing device to activate an alarm where the mobile computing device is no longer proximate to a docking station.

FIG. 12 is a flow chart illustrating an example module 899 executed by the mobile computing device 110 to activate an alarm where the mobile computing device is no longer proximate to a docking station. Shown is an operation 1201 executed to receive input to activate proximity detection. This input may be provided via the keypad 150 or screen 130 to activate proximity detection for the mobile computing device 110. Decision operation 1202 is executed to determine whether the mobile computing device 110 is transferring data or charging. This decision operation 1202 is executed as part of the charging detection logic 822 and data detection logic 826. In some example embodiments, the decision operation 1202 determines whether the mobile computing device 110 is receiving data. In cases where the decision operation 1202 evaluates to "true," the decision operation 1202 re-executes. In cases where the decision operation evaluates to "false," an operation 1203 is executed to transmit a signal to the processor 820 to activate an alarm in the form of visual and/or audible indicia. Operation 1204 is executed to activate the alarm. The operations 1203 and 1204 are executed as part of the alarm logic 828.

In the foregoing description, numerous details are set forth to provide an understanding of the present invention. However, it will be understood by those skilled in the art that the present invention may be practiced without these details. While the invention has been disclosed with respect to a limited number of embodiments, those skilled in the art will appreciate numerous modifications and variations therefrom. It is intended that the appended claims cover such modifications and variations as fall within the "true" spirit and scope of the invention.

What is claimed is:

1. A charging system comprising:

at least one coil to provide inductive charging for a mobile computing device;

a processor to control the inductive charging of the mobile computing device;

a proximity sensor operatively connected to the processor and positioned with respect to a surface of the charging system, the proximity sensor to determine when the mobile computing device is proximate to the surface of the charging system so that the mobile computing device can be inductively charged by the at least one coil; and wherein the processor implements an alarm logic module to (i) set an alarm in response to the proximity sensor determining that the mobile computing device is proximate to the surface of the charging system, and (ii) activate the alarm when the mobile computing device is no longer proximate to the surface of the charging system.

2. The charging system of claim 1, wherein the charging system includes at least one of a docking station, smart phone, slate computer, printer, or display device.

3. The charging system of claim 1, wherein the proximity sensor includes are least one of a proximity switch, a mechanical switch, an acoustic sensor, a Hall-Effect sensor, or an Infra-Red (IR) sensor.

4. The charging system of claim 1, wherein the alarm module activates the alarm by outputting at least one of a visual or audible indicia.

5. The charging system of claim 1, wherein the proximity sensor determines that the mobile computing device is proximate to the surface of the charging system when the mobile computing device is between 0-2 mm in distance from the surface of the charging system.

6. A mobile computing device comprising:

a touch-sensitive display screen to receive user input;

a speaker; and a processor coupled to the touch-sensitive display screen and the speaker, the processor to:

receive a user input, via the touch-sensitive display screen, to activate proximity detection for the mobile computing device, the proximity detection to detect when the mobile computing device is receiving an inductive signal from a charging device;

determine, via the proximity detection, that the mobile computing device is no longer receiving the inductive signal from the charging device as a result of the mobile computing device being moved away from a surface of the charging device; and in response to determining that the mobile computing device is no longer receiving the inductive signal, causing the speaker to output an audible indicia.

7. The mobile computing device of claim 6, further comprising a Light Emitting Diode (LED), wherein the processor causes the LED to provide a visual indicia in response to determining that the mobile computing device is no longer receiving the inductive signal.

8. The mobile computing device of claim 6, wherein the processor determines that the mobile computing device is no longer receiving the inductive signal by determining that the mobile computing device is no longer receiving data from the charging device as a result of the mobile computing device being moved away from the surface of the charging device.

9. The mobile computing device of claim 6, wherein the proximity detection sets a Boolean value denoting that the mobile computing device is to receive the inductive signal.

10. The mobile computing device of claim 9, wherein the processor, in response to determining that the mobile computing device is no longer receiving the inductive signal, sets the Boolean value to denote that the mobile computing device is no longer receiving the inductive signal in order to cause the speaker to output an audible indicia.

11. A computer implemented method for operating a mobile computing device, the method comprising:

receiving a user input, via a touch-sensitive display screen, to activate proximity detection for the mobile computing device, the proximity detection to detect when the mobile computing device is receiving an inductive signal from a charging device;

determining, via the proximity detection, that an the mobile computing device is no longer receiving the inductive signal from the charging device as a result of the mobile computing device no longer being proximate to a surface of the charging device; and in response to determining that the mobile computing device is no longer receiving the inductive signal, causing a speaker of the mobile computing device to output an audible indicia.

12. The computer implemented method of claim 11, wherein the charging device includes at least one of a docking station, smart phone, slate computer, printer, or display device.

13. The computer implemented method of claim 11, wherein determining that the mobile computing device is no longer receiving the inductive signal includes determining that the mobile computing device is no longer receiving data from the charging device as a result of the mobile computing device no longer being proximate to the surface of the charging device.

* * * * *

UNITED STATES PATENT AND TRADEMARK OFFICE

CERTIFICATE OF CORRECTION

PATENT NO. : 8,525,688 B2
APPLICATION NO. : 12/987940
DATED : September 3, 2013
INVENTOR(S) : Manjirnath Chatterjee et al.

It is certified that error appears in the above-identified patent and that said Letters Patent is hereby corrected as shown below:

In the Claims:

In column 11, line 15, in Claim 3, delete “are least” and insert -- at least --, therefor.

In column 12, line 25, in Claim 11, delete “an the” and insert -- the --, therefor.

Signed and Sealed this
Twenty-sixth Day of November, 2013

Margaret A. Focarino

Margaret A. Focarino
*Commissioner for Patents of the United States Patent and Trademark Office*